United States Patent [19]

Heeger

[11] 3,948,439

[45] Apr. 6, 1976

[54] SEDIMENT BUILDUP WARNING DEVICE FOR WATER HEATERS

[75] Inventor: Robert B. Heeger, Kankakee, Ill.

[73] Assignee: A. O. Smith Corporation, Milwaukee, Wis.

[22] Filed: Dec. 4, 1974

[21] Appl. No.: 529,456

[52] U.S. Cl. ..... 236/21 B; 122/504

[51] Int. Cl.[2] ..... F23N 5/24

[58] Field of Search ..... 236/21 R, 21 B; 122/504; 219/327, 328, 331, 322

[56] References Cited

UNITED STATES PATENTS

| | | | |
|---|---|---|---|
| 1,773,198 | 8/1930 | Piatt | 236/21 |
| 2,414,220 | 1/1947 | Alfery | 122/504 X |
| 2,670,902 | 3/1954 | Dotson | 236/21 |
| 2,879,358 | 3/1959 | Hilgert | 236/21 B X |
| 3,236,450 | 2/1966 | Bixby et al. | 236/21 B |
| 3,571,563 | 3/1971 | Shulz | 236/21 X |

*Primary Examiner*—William E. Wayner
*Assistant Examiner*—William E. Tapolcai, Jr.
*Attorney, Agent, or Firm*—Andrus, Sceales, Starke & Sawall

[57] ABSTRACT

A safety shut down warning assembly of the manual reset or recycling type installed at the lower section of a water heater storage vessel inside or outside the wall of the storage tank of the vessel to sense a predetermined increase in temperature above the normal operating temperature in the lower portion of the tank as the result of buildup of lime or other sediment in the bottom of the tank of the storage vessel. The sensing device is then activated by the increase in temperature to shut down the heating unit employed with the storage vessel to heat the water stored therein and/or turn on a warning light or other signal.

6 Claims, 4 Drawing Figures

SEDIMENT BUILDUP WARNING DEVICE FOR WATER HEATERS

BACKGROUND OF THE INVENTION

The life of a water heater storage vessel tends to be decreased because of an increase in temperature over the normal operating temperatures as the result of the buildup of lime or other sediment in the bottom of the storage vessel. In addition the service efficiency of the vessel is decreased because of the amount of fuel required for the heating unit to perform the heating task. The warning device provided by this invention overcomes these problems because it warns the user of the storage vessel to remove the insulating sediment from the bottom of the heater before a dangerous condition arises.

SUMMARY OF THE INVENTION

In general the invention is directed to a warning device which may be installed on the outside wall of the lower section of the tank of a water heater storage vessel which is heated by a gas burner or the like or immersed in the stored water of the heater at a predetermined location to signal the excessive buildup of sediment in the bottom of the vessel so that the sediment may be removed before damage is done to the vessel or excessive fuel utilized.

The warning device is essentially a temperature sensing device which has switching means such as a bimetal switch activated by a temperature rise in the stored water above the normal operating temperature as a result of the buildup of the sediment. The sensing device may be manually reset or be of the automatically recycling type. The switching means upon activation turns on a deliming warning light or other signal and also may be equipped to cut off the supply of fuel to the heating unit by closing a valve or the like in the conduit from the source of fuel.

DETAILED DESCRIPTION OF THE INVENTION

Figure 1:
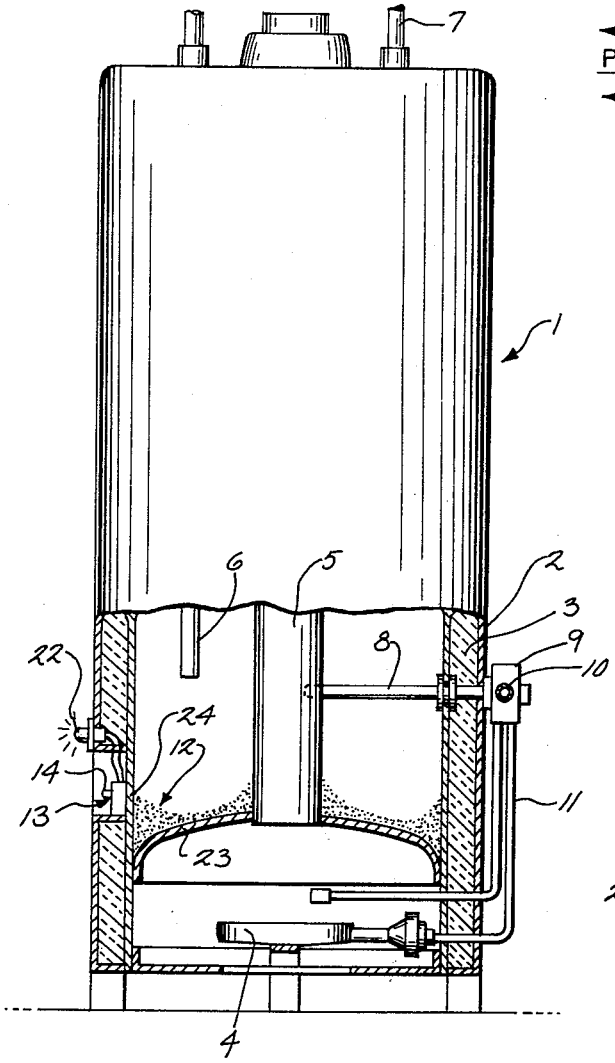
FIG. 1 is an elevational view of a water heater storage vessel which is heated by gas with parts broken away and sectioned to illustrate the temperature sensing warning device located on the outside of the tank of the vessel.

Referring to FIG. 1 there is shown a typical water heater storage vessel which has a tank 1 to store the water to be heated. The tank is enclosed in an exterior casing 2 and a layer of insulating material 3 is located in the annular space between tank 1 and casing 2.

The water storage vessel of FIG. 1 is heated by the gas burner 4 located beneath tank 1 and has a centrally located flue 5 for conducting the flue gas from burner 4 for discharge from the vessel. More than one flue 5 may be employed.

Cold water is supplied to the bottom portion of tank 1 through the dip tube 6 and a hot water outlet 7 is provided at the top of the water storage vessel.

Figure 2:
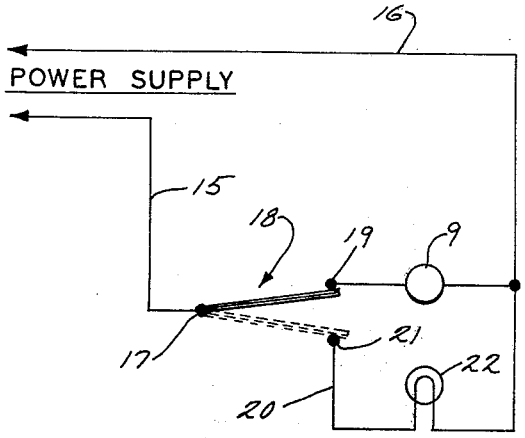
FIG. 2 is a diagrammatic view of the electrical circuitry of the temperature sensing warning device of FIG. 1 which includes a gas valve and warning light.

A thermostat 8 is disposed inside of tank 1 and when the water reaches a predetermined temperature, the solenoid operated gas valve 9 illustrated in FIGS. 1 and 2 which is connected to a gas supply pipe, not shown, but extending from opening 10 is closed to shut off the flow of gas through pipe 11 to burner 4. When the stored water cools to the temperature at which thermostat 8 is set, valve 9 is opened for flow of gas to burner 4.

In the course of the use of the water storage vessel it has been found that a sediment buildup such as of lime and other materials 12 will occur in the bottom portion of the heater as illustrated in FIG. 1. This sediment buildup acts as an insulating barrier to passage of heat from the gas burner 4 through the lower head of tank 1 to the stored water. This will be injurious to tank 1 over a period of time and also requires an additional supply of fuel over a period of time to heat the water to the temperature desired.

In order to sense the buildup of sediment in the bottom of the heater there is provided a temperature sensing warning device in the bottom of the heater.

In FIG. 1 there is illustrated a temperature sensing warning device 13 which is installed on the outside of the wall of tank 1 in the lower section of the tank where the sediment 12 there illustrated is located. The device 13 may be reactivated after the sediment has been removed by manually pressing button 14 as shown in FIG. 1 of the drawing or the sensing device 13 may be automatically recycled into operation, which is not shown.

FIG. 2 illustrates the electric circuitry which may be employed with the sensing device 13. The electrical conductors 15 and 16 are connected to a suitable power supply. Conductor 15 is connected to contact 17 to which is pivoted the bi-metal switch 18. Switch 18 operates between contact 17 to which it is secured and the contact 19 which it normally engages to complete a circuit through the solenoid operated main gas valve 9 and thence to the power source through the return conductor 16.

In addition a third conductor 20 is secured to the contact 21 and completes a circuit to return conductor 16 through the lamp 22. The contact 21 is located so as to be engaged by bi-metal switch 18 as shown in dotted lines in FIG. 2 when the blade 18 is not in normal engagement with contact 19.

The sensing device 13 is set for a predetermined temperature at which switch 18 will be opened. When the sediment 12 builds up within the bottom of the tank 1 the heat developed in the bottom head 23 is conducted through the head 23 and lower portion of the shell 24 of tank 1 to the sensing device 13. When the temperature conducted to sensing device 13 increases above the predetermined temperature for which device 13 is set bi-metal switch 18 is actuated and tripped out of engagement with contact 19 and into engagement with contact 21. This results in closing of the solenoid actuated main gas valve 9 and shutting off the gas burner 4 and the establishment of an electrical circuit through conductor 20 to light lamp 22. The user of the water storage heater is thus warned that a sediment buildup has occurred because the gas burner 4 has been shut off and no water is being heated and simultaneously the warning lamp 22 has been lighted. Good results have been obtained when sensing device 13 has been located within one to four inches above the lower end of the joint between lower head 23 and shell 24 of tank 1.

Figure 3:
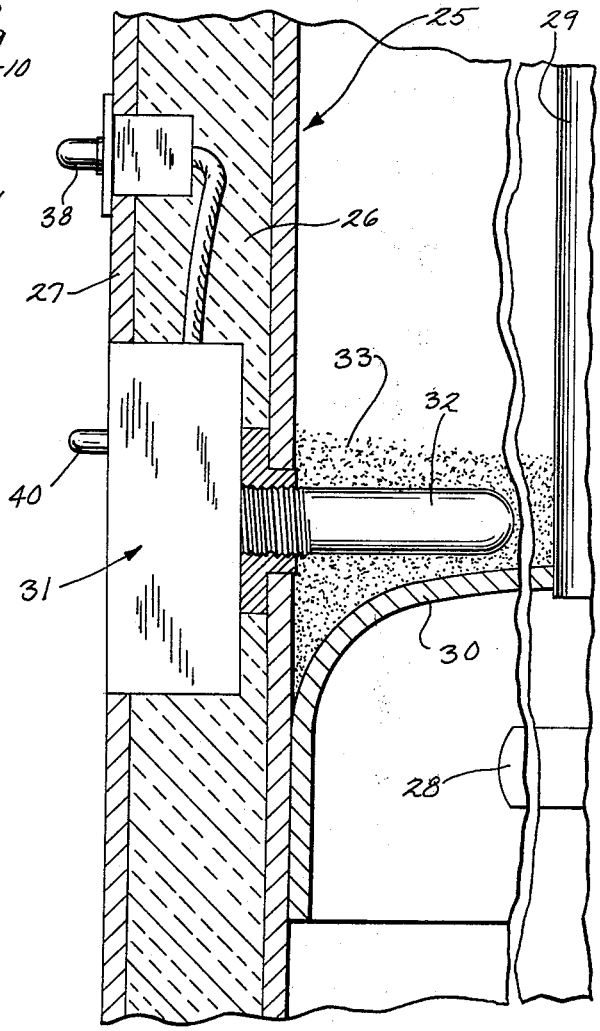
FIG. 3 is an enlarged sectional view of the lower portion of a water heater storage vessel which is heated by gas and illustrates a sensing device secured to the wall of the tank of the vessel and having a probe immersed in the water stored in the tank.

In a second embodiment of the invention a sensing device in FIG. 3 is shown immersed in the water stored in a water storage heater. In the second embodiment of FIG. 3 the lower portion of tank 25 of a water storage heater is surrounded by insulation 26 and an outer casing 27. A gas burner 28 is diagrammatically illustrated to heat the water stored in the tank 25 and a flue 29 is secured to the lower head 30 of tank 25 to discharge flue gases. A number of flues 29 may also be employed rather than a single flue 29.

In this embodiment, the sensing device 31 has a sensing probe 32 which is immersed within the water stored in tank 25. Sensing device 31 is set for a predetermined temperature. When there is a buildup of lime or other sediment 33 in the bottom of the tank 25 around probe 32 which acts as a heat insulation barrier lying over lower head 30, heat is generated in the head 30 and is conducted through lower head 30 to the shell of tank 25 and thence to probe 32. Probe 32 then actuates sensor 31 which includes the electrical circuit illustrated in FIG. 4.

Figure 4:
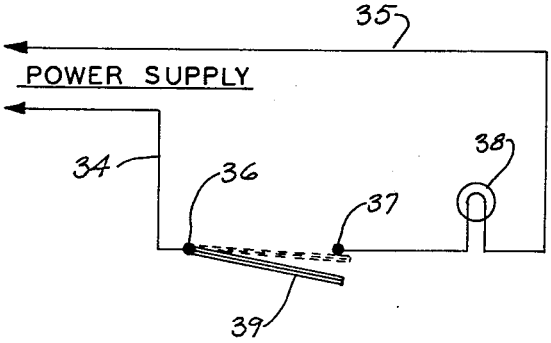
FIG. 4 is a diagrammatic view of an electrical circuit in the temperature sensing device of FIG. 3 which operates a warning light when the temperature exceeds the normal temperature at the bottom of the tank.

The circuit in FIG. 4 illustrates conductors 34 and 35 which are connected to a power source, not shown. Conductor 34 is connected to contact 36 and return conductor 35 is connected to contact 37 and in the return conductor 35 is located the lamp 38. The bi-metal switch 39 is connected to contact 36 and in normal operation of the water heater, the switch 39 is open as shown in FIG. 4. However when the temperature buildup of probe 32 of sensor 31 reaches the predetermined temperature for which sensor 31 is set, bi-metal switch 39 is closed as shown in dotted lines in FIG. 4. Upon closure of bi-metal switch 39 lamp 38 is lighted to provide a signal to the user of the water storage heater that there has been a buildup of sediment in the bottom of tank 25.

When the sediment has been removed the bi-metal switch 39 may be manually reactivated to normal position by pressing button 40 on sensor 31.

Although in both embodiments of the invention a bimetallic switch has been illustrated as a part of the sensor device to actuate the warning signals of sediment buildup, other types of temperature sensing devices may be employed.

Furthermore, the safety shut down warning means may be a combination of the shut off of fuel to the main heating unit in combination with a lamp or buzzer or other signal or such safety shut down warning means units can be used alone as illustrated with the use of only lamp 38 in FIG. 4.

The temperature sensing warning device provides an effective warning of sediment buildup in the bottom portion of the tank of a water storage heater which then can be removed by draining the water heater before harm is done to the heater or excessive fuel used to heat the water in the water storage heater.

Various modes of carrying out the invention are contemplated as being within the scope of the following claims particularly pointing out and distinctly claiming the subject matter which is regarded as the invention.

I claim:

1. In a water storage tank adapted to contain water to be heated and having a shell closed at the lower end by a bottom head joined to the shell, a gas heating unit located adjacent the bottom head of the tank to heat said water, at least one flue secured to the bottom head above the gas heating unit and extending upwardly within the tank for discharge of flue gases, a first temperature sensor for controlling normal operation of the heating unit a temperature sensing warning device in contact with the wall of the tank located below said first sensor and from one to four inches above the joint between the lower head and shell with said device being disposed to sense the increase in temperature in the tank wall above the normal operating temperature as the result of buildup of insulating sediment on the bottom head of the storage tank preventing the passage of heat from the heating unit through the bottom head to the water contained in the tank, a safety shut down warning means associated with the temperature sensing device, and switching means electrically connected to the temperature sensing device and to the safety shut down warning means to actuate the latter when the switching means is operated by the temperature sensing device when the latter senses temperature in the tank wall which is above normal.

2. The construction of claim 1 in which the safety shut down means is a normally open gas valve for flow of gas to the burner and closed when the switching means is opened by the temperature sensing device to cut off the flow of gas.

3. The construction of claim 2 and a warning signal provided on the heater as part of the safety shut down means to warn the user of the abnormal temperature problem.

4. The construction of claim 1 in which the heating unit is a gas burner located below the bottom head of the water storage tank, at least one flue secured to said tank for the discharge of gases from the burner, and the safety shut down means being a normally unlighted lamp and which is lighted when the switching means closes a circuit through the lamp when the temperature sensing warning device is actuated by a rise in temperature.

5. The construction of claim 1 in which the temperature sensing device is located against the outside wall of the water storage tank.

6. The construction of claim 1 in which the temperature sensing device has a temperature sensing probe which is immersed in the stored water in the water storage tank adjacent the bottom of the tank and in heat sensing engagement with the tank wall.

* * * * *